US005536336A

United States Patent [19]

Nakatsukasa et al.

[11] Patent Number: 5,536,336

[45] Date of Patent: *Jul. 16, 1996

[54] METHOD OF PHOSPHATING METAL SURFACES AND TREATMENT SOLUTION

[75] Inventors: Mikio Nakatsukasa, Hiroshima; Isao Kawasaki, Osaka, both of Japan

[73] Assignee: Nippon Paint Co., Ltd., Osaka, Japan

[ * ] Notice: The term of this patent shall not extend beyond the expiration date of Pat. No. 5,258,079.

[21] Appl. No.: 358,001

[22] Filed: Dec. 16, 1994

[30] Foreign Application Priority Data

Dec. 21, 1993 [JP] Japan ..... 5-321514

[51] Int. Cl.[6] ..... C23C 22/12

[52] U.S. Cl. ..... 148/262

[58] Field of Search ..... 148/260, 262

[56] References Cited

U.S. PATENT DOCUMENTS

| | | | |
|---|---|---|---|
| 4,849,031 | 7/1989 | Hauffe | 148/262 |
| 5,082,511 | 1/1992 | Farina | 148/262 |
| 5,211,769 | 5/1993 | Sobata | 148/262 |
| 5,258,079 | 11/1993 | Nakatsukasa | 148/262 |
| 5,308,413 | 5/1994 | Sobata | 148/262 |

FOREIGN PATENT DOCUMENTS

| | | |
|---|---|---|
| 0039093 | 3/1981 | European Pat. Off. . |
| 0261704 | 8/1987 | European Pat. Off. . |
| 0304108 | 7/1988 | European Pat. Off. . |
| 0381190 | 1/1990 | European Pat. Off. . |
| 0401616 | 5/1990 | European Pat. Off. . |
| 0452638 | 2/1991 | European Pat. Off. . |

*Primary Examiner*—Sam Silverberg

*Attorney, Agent, or Firm*—Townsend & Banta

[57] ABSTRACT

A method of chemically converting metal surfaces of a combination of iron steel and/or galvanized steel and an aluminum alloy with a phosphate solution satisfying the following conditions:

$2.0 \leqq$ Na ion+K ion $\leqq 15.0$ (g/l)

$1.0 \leqq$ Mn ion+Ni ion $\leqq 5.0$ (g/l)

$1.6-0.02T \leqq$ Zn ion $\leqq 2.5-0.02T$ (g/l)

$3.2T^{-1} \leqq$ free F ion $\leqq 8.0T^{-1}$ (g/l)

$0.014T-0.02(\text{free F ion})^{-1} \leqq$ free acidity $\leqq 0.027T-0.02(\text{free F ion})^{-1}$ (g/l)

where T represents a treatment solution temperature (° C.).

9 Claims, 1 Drawing Sheet

METHOD OF PHOSPHATING METAL SURFACES AND TREATMENT SOLUTION

BACKGROUND OF THE INVENTION

1. Field of the Invention

The present invention relates to a method of phosphating metal surfaces, and more specifically, it relates to a treatment method for forming a phosphate coating on metal surfaces of a combination of iron steel and/or galvanized steel and an aluminum alloy.

2. Description of the Background Art

Conversion treatment of forming a phosphate coating, which is basically composed of zinc phosphate, on a metal surface for improving finishing in coating and a rust preventing function is generally well known in the art.

While steel and galvanized steel are generally employed as metal materials which are subjected to conversion treatment, a material prepared by combining steel and/or galvanized steel with an aluminum alloy is recently employed in order to attain lightweightness in an automobile body or the like. Thus, awaited is a treatment method of simultaneously forming a phosphate coating which is basically composed of zinc phosphate on such a composite metal material, similarly to the conventional method.

As to conversion treatment for such a metal material which is prepared by combining iron steel or galvanized steel with an aluminum alloy, each of Japanese Patent Laying-Open Nos. 63-15789 (1988) and 64-68481 (1989) discloses a treatment method employing a phosphate treatment solution containing a fluoride. In the technique disclosed in either gazette, however, it is impossible to form a homogeneous and excellent phosphate coating in any or all metal surfaces of the steel, the galvanized steel and the aluminum alloy, and no sufficient performance can be attained as a cation coating substrate.

On the other hand, Japanese Patent Laying-Open No. 3-267378 (1991) discloses a treatment method of forming a homogeneous phosphate coating on a structure which consists of steel, galvanized steel and an aluminum alloy while defining relations between the treatment temperature and amounts of fluorine ions and zinc ions. According to the method which is disclosed in this gazette, it is possible to form a homogeneous phosphate coating on metal materials of a combination of steel, galvanized steel and an aluminum alloy, thereby obtaining a conversion coating having excellent corrosion resistance.

In recent years, however, awaited is a treatment method capable of forming a conversion coating having superior corrosion resistance, which exhibits excellent corrosion resistance also in a composite corrosion cycle test, being a severer corrosion resistance test.

SUMMARY OF THE INVENTION

An object of the present invention is to provide a phosphating method which can attain excellent corrosion resistance in the aforementioned composite corrosion cycle test.

The present invention is directed to a method of conversion-treating metal surfaces of a combination of iron steel and/or galvanized steel and an aluminum alloy with a phosphate solution. According to the present invention, the phosphate solution which is employed for the conversion treatment satisfies the following conditions:

$2.0 \leqq \text{Na ion} + \text{K ion} \leqq 15.0$ (g/l)

$1.0 \leqq \text{Mn ion} + \text{Ni ion} \leqq 5.0$ (g/l)

$1.6 - 0.02T \leqq \text{Zn ion} \leqq 2.5 - 0.02T$ (g/l)

$3.2T^{-1} \leqq \text{free F ion} \leqq 8.0T^{-1}$ (g/l)

$0.014T - 0.02(\text{free F ion})^{-1} \leqq \text{free acidity} \leqq 0.027T - 0.02(\text{free F ion})^{-1}$ (g/l)

where T represents the treatment solution temperature (° C.).

The inventive conversion method can be carried out in the range of a treatment solution temperature which is capable of performing conversion treatment with the phosphate solution having the aforementioned composition. Specifically, the inventive method can be carried out at a treatment solution temperature in the range of about 20° C. to about 60° C. It is assumed that a significant figure calculated through the above expression of free acidity is obtained by cutting off two places of decimals.

The inventors have employed phosphate treatment solutions containing ions of Na, K, Mn, Ni and Zn in the aforementioned ranges, to study relations between Free F ion concentration and free acidity in treatment solutions providing conversion coatings having excellent after-coating performance at treatment solution temperatures in the range of 20° C. to 60° C. Consequently, they have discovered that it is possible to form excellent coatings at respective treatment solution temperatures of 60° C., 40° C., 30° C. and 20° C. with free F ion concentration and free acidity in regions shown with slant lines in FIG. 1. Thus, it has been proved that conditions of free F ion concentration, free acidity and treatment solution concentration capable of forming an excellent coating are provided by the following expressions:

$$3.2T^{-1} \leqq \text{free F ion} \leqq 8.0T^{-1} \text{ (g/l)}$$

$$0.014T - 0.02(\text{free F ion})^{-1} \leqq \text{free acidity} \leqq 0.027T - 0.02(\text{free F ion})^{-1} \text{ (g/l)}$$

where T represents the treatment solution temperature (° C.).

When the free F ion concentration is less than the lower limit in the above expression, aluminum ion masking reaction (insolubilization) by the free F ions as well as formation of the coating on the iron steel material and/or the galvanized steel material are so insufficient that it is impossible to attain desired after-coating performance even if free acidity is controlled in the aforementioned range. When the free F ion concentration exceeds the upper limit in the above expression, on the other hand, the rate of phosphate forming reaction is so excessively increased that sodium salt and potassium salt of aluminum are mixed into the conversion coating which is formed on the surface of the aluminum alloy. Therefore, a tendency of deterioration is recognized in after-coating performance of a ground portion of the aluminum alloy in a composite corrosion cycle test, while a defect of the coating surface or imperfect adhesion of the coating may be caused in cation electrodeposition coating.

When the free acidity is less than the lower limit in the above expression, stability of the metal ions contained in the treatment solution is so reduced that it may be difficult to maintain the metal ions in a proper quantity or a defective coating may be formed. If the free acidity exceeds the upper limit in the above expression, on the other hand, formation of the phosphate coating on the aluminum alloy surface is so insufficient that prescribed after-coating performance cannot be attained.

In the present invention, the free acidity is expressed in consumption (ml) of 0.1N-NaOH which is required for neutralizing 10 ml of the treatment solution with Bromophenol Blue serving as an indicator.

During the conversion treatment, aluminum ions derived from the aluminum alloy are coupled with the free F ions contained in the treatment solution to form complex ions, and hence the free F ion concentration is reduced with progress of the treatment. Therefore, a free F ion supply source is required for the treatment solution, in order to maintain the free F ion concentration in the range of the above expression.

While the free F ion supply source can be prepared from an arbitrary compound which is capable of supplying free F ions, it is preferable to employ at least one compound selected from the group consisting of hydrofluoric acid, potassium fluoride, sodium fluoride, acid potassium fluoride, acid sodium fluoride, ammonium fluoride and acid ammonium fluoride, in particular. Further, a complex fluoride such as $HBF_4$ or $H_2SiF_6$ may coexist with the free F ions.

The aluminum ions which are complexed with the free F ions form $Na_3AlF_6$, $K_3AlF_6$, $NaK_2AlF_6$ and/or $(K, Na)_3AlF_6$ under presence of sodium and/or potassium contained in the treatment solution, and insolubilized.

The amount of sodium and potassium ions which are required for such insolubilization of the aluminum ions are as follows:

$$2.0 \leqq \text{Na ion} + \text{K ion} \leqq 15.0 \text{ (g/l)}$$

It is possible to properly facilitate reaction between the free F ions and the aluminum ions, by managing the sodium concentration and the potassium concentration in the above range.

In order to form a phosphate coating which is basically composed of zinc phosphate on the metal surfaces, it is also important to manage zinc ion concentration in the treatment solution. The treatment temperature also influences on phosphate coating formation of the zinc ions. According to the present invention, the zinc ion concentration is controlled in response to the treatment temperature, in the following expression:

$$1.6-0.02T \leqq \text{Zn ion} \leqq 2.5-0.02T \text{ (g/l)}$$

When the zinc ion concentration is less than the lower limit in the above expression, it is impossible to form a homogeneous coating on the aluminum alloy and the steel. When the zinc ion concentration exceeds the upper limit, on the other hand, it is impossible to form a substrate coating which is suitable for cation electrodeposition coating on any of the iron steel, galvanized steel and aluminum alloy surfaces. Also as to the zinc ion concentration, phosphate coating formation is actively facilitated by the zinc ions as the treatment temperature is increased, and hence the upper and lower limits of the range of concentration which is capable of forming an excellent coating are reduced.

In order to improve water resistance/adhesion of the coating which is formed on the aluminum alloy and the galvanized steel in cation electrodeposition coating, the treatment solution preferably contains manganese ions and/or nickel ions. According to the present invention, concentration of the manganese ions and/or nickel ions is set in the following range:

$$1.0 \leqq \text{Mn ion} + \text{Ni ion} \leqq 5.0 \text{ (g/l)}$$

The inventive phosphating method can be carried out through and under a procedure and conditions which are similar to those of ordinary phosphating, while the treatment solution can be brought into contact with the metal surfaces by a method similar to that employed in ordinary phosphating, such as dipping or spraying. For example, it is possible to efficiently form a homogeneous and excellent phosphate coating by combining dipping of at least 15 seconds and subsequent spraying of at least 2 seconds.

A phosphating solution according to the present invention, which is employed for the aforementioned inventive phosphating method, contains 0.1 to 2.1 g/l, preferably 0.4 to 2.1 g/l of Zn ions, 5 to 40 g/l, preferably 10 to 30 g/l of phosphate ions, 0 to 4 g/l, preferably 0.1 to 2 g/l of Ni ions, 0 to 3 g/l, preferably 0.5 to 3 g/l of Mn ions, 0 to 15 g/l of Na ions, 0 to 15 g/l of K ions, 0.05 to 0.4 g/l of free F ions, 0 to 3 g/l, preferably 0.05 to 1 g/l of a complex fluoride in terms of HF, and a proper amount of a conversion accelerator.

Examples of the complex fluoride are $H_2SiF_6$, $HBF_4$, and salts thereof.

Examples of the free F ion supply source ere HF, NaF, KF, $NH_4F$, $NaHF_2$, $KHF_2$ and $NH_4HF_2$.

Examples of the conversion accelerator employable in the present invention are 0.01 to 0.2 g/l of nitrite ions, 1 to 10 g/l of nitrate ions, 0.05 to 2.0 g/l of nitrobenzenesulfonate ions, 0.05 to 5.0 g/l of chlorate ions, and 0.05 to 2.0 g/l of hydrogen peroxide.

The inventive phosphating method provides excellent corrosion resistance which is sufficiently satisfactory under conditions severer than the conventional ones. Under severe conditions, corrosion resistance on the surface of the aluminum alloy, particularly on a ground portion of the aluminum alloy material comes to a question. After-coating performance of such an aluminum alloy surface is particularly remarkably influenced by the weight of the conversion coating. The weight of the coating is conceivably influenced by the free F ion concentration and the hydrogen ion exponent(pH) of the treatment solution. According to the present invention, the free F ion concentration and the free acidity are specified in the prescribed ranges in response to the treatment solution temperature. Thus, the free F ion concentration and the hydrogen ion exponent of the treatment solution are conceivably under conditions for providing a high quality coating having a sufficient weight on the aluminum alloy surface, to improve after-coating performance such as corrosion resistance as the result.

According to the inventive phosphating method, it is possible to homogeneously form a high quality phosphate coating on all metal surfaces of the iron steel, the galvanized steel and the aluminum alloy, thereby attaining a coating which exhibits excellent corrosion resistance in a composite corrosion cycle test, being a severe corrosion resistance test.

The foregoing and other objects, features, aspects and advantages of the present invention will become more apparent from the following detailed description of the present invention when taken in conjunction with the accompanying drawing.

DESCRIPTION OF THE PREFERRED EMBODIMENTS

Figure 1:
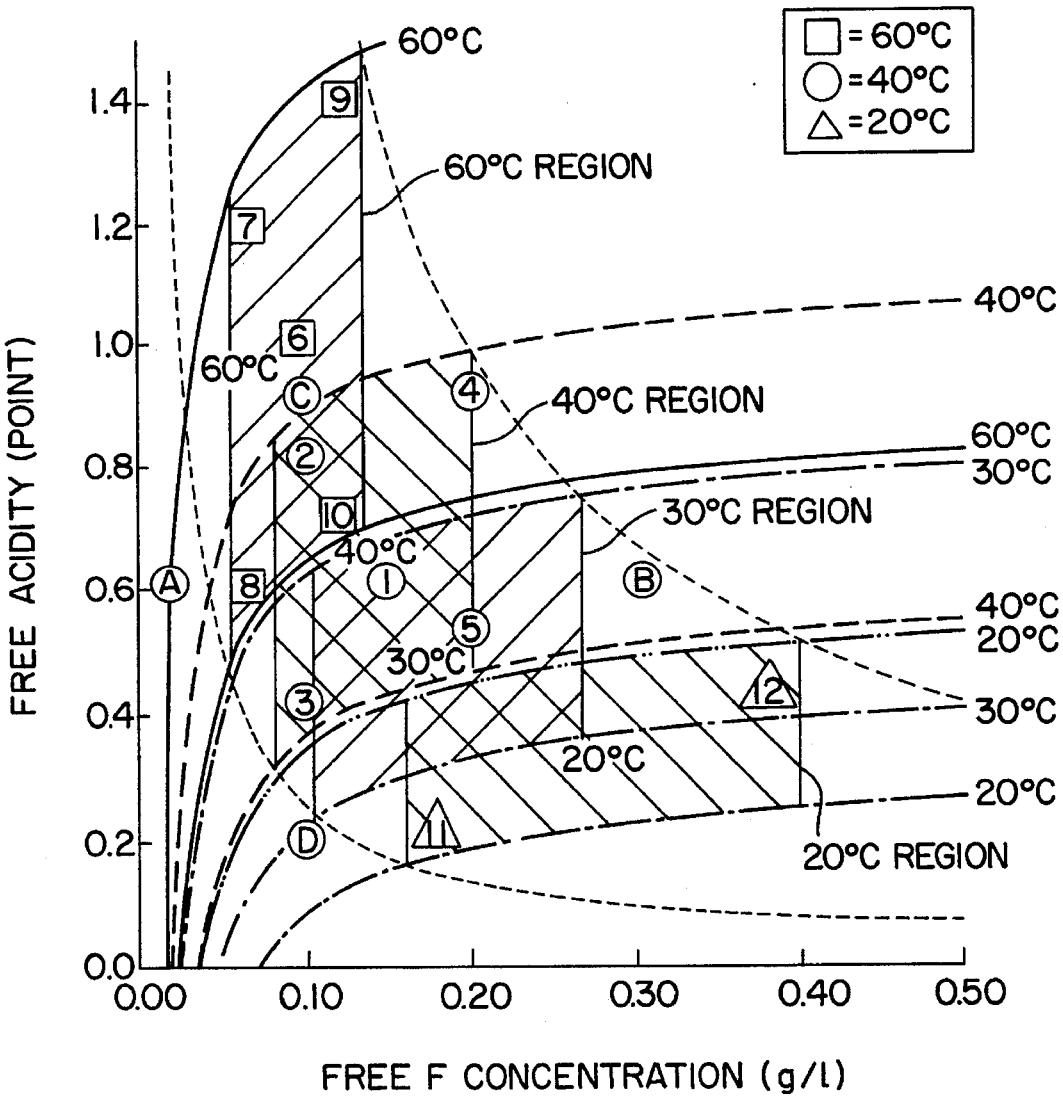
FIG. 1 illustrates ranges of free F ion concentration and free acidity defined according to the present invention.

Examples of the present invention are now described in detail.

Target Plate

Target plates were prepared by combining the following three types of metals:

cold-rolled steel plate: JIS-G-3141 galvanized steel plate: Zn-Ni alloy electroplated steel plate aluminum alloy plate: Al-Mg alloy (aluminum alloy plate was partially subjected to double action sanding with abrasive of GRID80, and ground).

Such target plates were washed with an alkaline degreasing agent which was mainly composed of sodium phosphate so that the metal material surfaces were cleaned, then rinsed with water, and surface conditioned with aqueous titanium salt. Then, the target plates were phosphated under treatment conditions described below, rinsed with water and pure water, and thereafter subjected to cation electrodeposition, intermediate coating and overcoating, for evaluation of after-coating performance.

Surface Treatment Step (1) Degreasing

The target plates were dipped in a 2.0 wt. % aqueous solution of an alkaline degreasing agent (Surfcleaner SD270TO by Nippon Paint Co., Ltd.) at 40° C. for 2 minutes, to be degreased.

(2) Water Rinsing

The target plates were spray-washed with service water at the room temperature for 30 seconds.

(3) Surface Conditioning

The target plates were dipped in a 0.1 wt. % aqueous solution of a surface conditioning agent (Surffine 5MZ by Nippon Paint Co., Ltd.) at the room temperature for 15 seconds.

(4) Phosphating

The target plates were dipped in treatment solutions having compositions shown in Tables 1 to 3 for 2 minutes. Tables 1 and 2 show inventive Examples, and Table 3 shows comparative examples.

Comparative example A had a small content of free F ions, comparative example B had a large content of free F ions, comparative example C had high free acidity, comparative example D had low free acidity, comparative example E had small contents of Mn ions and Ni ions, comparative example F had a large content of Zn ions, and comparative example G had a small content of Zn ions. Comparative example D had a small content of Zn ions, since the Zn ions were not stably held in the bath due to the low free acidity.

(5) Water Rinsing

The target plates were spray-washed with service water at the room temperature for 30 seconds.

(6) Deionized Water Rinsing

The target plates were dipped in deionized water at the room temperature for 15 seconds.

Coating Step (1) Undercoating

The target plates were coated with a cationic electrocoating paint (OTO-U-2602 by Nippon Paint Co., Ltd.) to obtain coatings of 25 μm in film thickness, which in turn were baked at 160° C. for 20 minutes.

(2) Intermediate Coating

The target plates were spray-coated with a melamine-alkyd intermediate coating paint (Orga TO 4830 by Nippon Paint Co., Ltd.) and baked at 140° C. for 25 minutes, to obtain coatings of 35 μm in film thickness.

(3) Top Coating

The target plates were spray-coated with a melamine-alkyd top coating paint (Orga TO 640 by Nippon Paint Co., Ltd.) and baked at 140° C. for 25 minutes, to obtain coatings of 35 μm in film thickness.

Evaluation

The target plates which were phosphated and coated under the aforementioned conditions were subjected to measurement of coating weights, an adhesion test, a filiform corrosion test, a salt spray test, and a composite corrosion cycle test, for evaluation of the coating surfaces. Tables 1 to 3 shows the results. The evaluation was made on the aluminum alloy surfaces (Al materials (including ground surfaces)), the steel surfaces (Fe materials) and the galvanized steel surfaces (Zn materials).

(1) Adhesion Test

The target plates were dipped in deionezed water of 50° C. for 10 days, and thereafter cut into the form of grids having 100 pieces at intervals of 2 mm with a sharp cutter. Adhesive tapes were brought into pressure contact with the grid surfaces and then separated perpendicularly to the surfaces, for measuring the rates (%) of the pieces remaining on the plates.

(2) Filiform Corrosion Test

The target plates on which cutting was given to a salt spray test (JIS-Z-2371) for 24 hours, and thereafter subjected to a humidity cabinet test under relative humidity of 75 to 85% and a temperature of 50° C. for 1000 hours. After these tests, filiform corrosion lengths from the cut portions were measured.

(3) Salt Spray Test

The target plates were cross-cut and set in a salt spray tester for 1000 hours in accordance with the aforementioned JIS-Z-2371, for measurement of single-side maximum corrosion lengths from the cut surfaces.

(4) Composite Corrosion Cycle Test

The target plates on which cutting was given were brought into a corrosive environment atmosphere for 60 cycles, and measurement was made similarly to the aforementioned salt spray test. Each cycle was carried out as follows:

salt spray (JIS-Z-2371) for 6 hours→drying (at 50° C. for 3 hours)→wetting (at 50° C. under at least 95% RH for 14 hours)→room temperature drying (at the room temperature for 1 hour)

TABLE 1

| | | 1 | 2 | 3 | 4 | 5 | 6 |
|---|---|---|---|---|---|---|---|
| Composition of Treatment Solution | Na (g/l) | 5.0 | 5.0 | 5.0 | 5.0 | 5.0 | 5.0 |
| | K (g/l) | 1.0 | 1.0 | 1.0 | 1.0 | 1.0 | 1.0 |
| | Mn (g/l) | 0.6 | 0.6 | 0.6 | 0.6 | 0.6 | 0.6 |
| | Ni (g/l) | 1.0 | 1.0 | 1.0 | 1.0 | 1.0 | 1.0 |
| | Zn (g/l) | 1.0 | 1.0 | 1.0 | 1.0 | 1.0 | 0.8 |
| | F (g/l) | 0.15 | 0.10 | 0.10 | 0.20 | 0.20 | 0.09 |
| | $SiF_6$ (g/l) | 1.00 | 1.00 | 1.00 | 1.00 | 1.00 | 1.00 |
| | $NO_3$ (g/l) | 5.0 | 5.0 | 5.0 | 5.0 | 5.0 | 5.0 |
| | $NO_2$ (g/l) | 0.06 | 0.06 | 0.06 | 0.06 | 0.06 | 0.06 |
| | FA (po.) | 0.6 | 0.8 | 0.4 | 0.9 | 0.5 | 1.0 |
| | Temper- | 40 | 40 | 40 | 40 | 40 | 60 |

TABLE 1-continued

| | | 1 | 2 | 3 | 4 | 5 | 6 |
|---|---|---|---|---|---|---|---|
| | ature (°C.) | | | | | | |
| Weight of Coating ($g/m^2$) | Al | 1.6 | 1.2 | 1.7 | 1.5 | 1.8 | 1.6 |
| | Fe | 2.4 | 2.4 | 2.5 | 2.4 | 2.5 | 2.4 |
| | Zn | 2.8 | 2.8 | 2.9 | 2.8 | 2.9 | 2.8 |
| Adhesion (pieces) | Al | 100 | 100 | 100 | 100 | 100 | 100 |
| | Fe | 100 | 100 | 100 | 100 | 100 | 100 |
| | Zn | 100 | 100 | 100 | 100 | 100 | 100 |
| Filiform Corrosion (mm) | Al | 1.0 | 2.5 | 1.0 | 1.5 | 1.5 | 1.5 |
| | Fe | 1.6 | 1.5 | 2.0 | 1.6 | 2.2 | 1.4 |
| | Zn | 0.5 | 0.5 | 0.6 | 0.7 | 0.8 | 0.6 |
| Salt Spray (mm) | Al | 0.5 | 1.0 | 0.4 | 0.8 | 0.7 | 0.5 |
| | Fe | 1.0 | 0.3 | 1.0 | 1.0 | 1.1 | 0.9 |
| | Zn | 1.5 | 1.2 | 1.3 | 1.8 | 1.9 | 1.5 |
| Composite Corrosion (mm) | Al | 2.0 | 2.2 | 1.6 | 2.1 | 2.2 | 1.9 |
| | Fe | 2.9 | 2.8 | 2.9 | 2.6 | 2.9 | 2.7 |
| | Zn | 2.3 | 2.2 | 2.2 | 2.4 | 2.4 | 2.2 |

TABLE 2

| | | 7 | 8 | 9 | 10 | 11 | 12 |
|---|---|---|---|---|---|---|---|
| Composition of Treatment Solution | Na (g/l) | 5.0 | 5.0 | 5.0 | 5.0 | 5.0 | 5.0 |
| | K (g/l) | 1.0 | 1.0 | 1.0 | 1.0 | 1.0 | 1.0 |
| | Mn (g/l) | 0.6 | 0.6 | 0.6 | 0.6 | 0.6 | 0.6 |
| | Ni (g/l) | 1.0 | 1.0 | 1.0 | 1.0 | 1.0 | 1.0 |
| | Zn (g/l) | 1.0 | 0.8 | 1.0 | 0.8 | 1.5 | 1.8 |
| | F (g/l) | 0.06 | 0.06 | 0.12 | 0.12 | 0.18 | 0.38 |
| | $SiF_6$ (g/l) | 1.00 | 1.00 | 1.00 | 1.00 | 1.00 | 1.00 |
| | $NO_3$ (g/l) | 5.0 | 5.0 | 5.0 | 5.0 | 6.0 | 6.0 |
| | $NO_2$ (g/l) | 0.08 | 0.06 | 0.06 | 0.06 | 0.08 | 0.08 |
| | FA (po.) | 1.2 | 0.6 | 1.4 | 0.7 | 0.2 | 0.4 |
| | Temperature (°C.) | 60 | 60 | 60 | 60 | 20 | 20 |
| Weight of Coating ($g/m^2$) | Al | 1.3 | 1.7 | 1.3 | 1.8 | 1.3 | 1.2 |
| | Fe | 2.3 | 2.4 | 2.2 | 2.4 | 2.5 | 2.3 |
| | Zn | 2.8 | 2.8 | 2.8 | 2.8 | 2.9 | 2.9 |
| Adhesion (pieces) | Al | 100 | 100 | 100 | 100 | 100 | 100 |
| | Fe | 100 | 100 | 100 | 100 | 100 | 100 |
| | Zn | 100 | 100 | 100 | 100 | 100 | 100 |
| Filiform Corrosion (mm) | Al | 2.5 | 1.0 | 2.5 | 1.5 | 2.5 | 3.0 |
| | Fe | 1.6 | 1.5 | 2.0 | 1.5 | 2.5 | 2.2 |
| | Zn | 0.5 | 0.5 | 0.6 | 0.6 | 0.8 | 0.8 |
| Salt Spray (mm) | Al | 1.0 | 0.5 | 1.0 | 0.7 | 1.0 | 1.2 |
| | Fe | 0.9 | 0.8 | 1.0 | 0.8 | 1.1 | 1.0 |
| | Zn | 1.3 | 1.3 | 1.2 | 1.3 | 1.9 | 1.9 |
| Composite Corrosion (mm) | Al | 2.0 | 1.9 | 2.1 | 2.0 | 2.5 | 2.2 |
| | Fe | 2.6 | 2.6 | 2.7 | 2.6 | 3.0 | 2.9 |
| | Zn | 2.2 | 2.2 | 2.3 | 2.2 | 2.4 | 2.4 |

TABLE 3

| | | A | B | C | D | E | F | G |
|---|---|---|---|---|---|---|---|---|
| Composition Treat Treatment Solution | Na (g/l) | 5.0 | 5.0 | 5.0 | 5.0 | 5.0 | 5.0 | 5.0 |
| | K (g/l) | 1.0 | 1.0 | 1.0 | 1.0 | 1.0 | 1.0 | 1.0 |
| | Mn (g/l) | 0.6 | 0.6 | 0.6 | 0.6 | 0.5 | 0.6 | 0.6 |
| | Ni (g/l) | 1.0 | 1.0 | 1.0 | 1.0 | 0.3 | 1.0 | 1.0 |
| | Zn (g/l) | 1.0 | 1.0 | 1.0 | 0.7 | 1.2 | 1.6 | 0.8 |
| | F (g/l) | 0.01 | 0.30 | 0.10 | 0.10 | 0.15 | 0.10 | 0.15 |
| | $SiF_6$ (g/l) | 1.00 | 1.00 | 1.00 | 1.00 | 1.00 | 1.00 | 1.00 |
| | $NO_3$ (g/l) | 5.0 | 5.0 | 5.0 | 5.0 | 5.0 | 5.0 | 5.0 |
| | $NO_2$ (g/l) | 0.06 | 0.06 | 0.06 | 0.06 | 0.06 | 0.06 | 0.08 |
| | FA (po.) | 0.6 | 0.6 | 0.9 | 0.2 | 0.6 | 0.6 | 0.4 |
| | Temperature (°C.) | 40 | 40 | 40 | 40 | 40 | 50 | 35 |
| Weight of Coating ($g/m^2$) | Al | 0.4 | 1.7 | 0.3 | 0.7 | 1.9 | 2.0 | 0.3 |
| | Fe | 2.4 | 2.4 | 2.4 | 1.9 | 2.4 | 2.6 | 1.9 |
| | Zn | 2.8 | 2.7 | 2.8 | 2.2 | 2.8 | 3.2 | 2.3 |
| Adhesion (pieces) | Al | 100 | 100 | 100 | 100 | 50 | 80 | 90 |
| | Fe | 100 | 100 | 100 | 90 | 50 | 50 | 50 |
| | Zn | 100 | 100 | 100 | 90 | 10 | 50 | 50 |
| Filiform Corrosion (mm) | Al | 5.5 | 3.5 | 7.0 | 6.0 | 9.0 | 3.0 | 10.0 |
| | Fe | 1.7 | 1.8 | 1.6 | 3.0 | 3.0 | 1.9 | 4.0 |
| | Zn | 0.6 | 0.8 | 0.5 | 0.9 | 0.9 | 0.7 | 0.6 |
| Salt Spray (mm) | Al | 3.1 | 1.2 | 3.5 | 3.2 | 3.5 | 2.0 | 3.5 |
| | Fe | 1.0 | 1.2 | 1.0 | 3.0 | 2.5 | 2.5 | 3.9 |
| | Zn | 2.0 | 2.0 | 1.9 | 2.5 | 2.5 | 2.0 | 2.0 |
| Composite Corrosion (mm) | Al | 4.2 | 4.2 | 4.2 | 4.2 | 4.3 | 3.5 | 4.5 |
| | Fe | 2.8 | 2.9 | 2.7 | 4.5 | 3.8 | 3.1 | 3.9 |
| | Zn | 2.2 | 2.5 | 2.3 | 3.0 | 3.0 | 2.4 | 2.6 |

FIG. 1 shows values of free F ion concentration and free acidity of Examples 1 to 12 and comparative examples A to D. Referring to FIG. 1, □, ○ and Δ show values at 60° C., 40° C. and 20° C. respectively. As clearly understood from FIG. 1, comparative examples A to D are in positions separated from the region of 40° C.

It is clearly understood from Tables 1 and 2 that Examples 1 to 12 according to the present invention have sufficient coating weights and obtain excellent results in the adhesion, filiform corrosion, salt spray and composite corrosion cycle tests in the Al, Fe and Zn materials.

On the other hand, comparative examples A to D are insufficient in filiform corrosion resistance of the Al materials, and corrosion resistance in the salt spray test and the composite corrosion cycle test, despite the sufficient results in adhesion.

Comparative example E, having contents of Mn and Ni ions less than the inventive ranges, are inferior in adhesion and corrosion resistance. Comparative example F, having a content of Zn ions larger than the inventive range, is reduced in adhesion to the Fe and Zn materials, and inferior in corrosion resistance. Comparative example G, having a small content of Zn ions, is reduced in coating weight particularly with respect to the Al material, and inferior in adhesion and corrosion resistance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A phosphating method of conversion-treating metal surfaces of a combination of iron steel and/or galvanized steel and an aluminum alloy with a phosphate solution, said phosphate solution satisfying the following conditions:

$$2.0 \leqq \text{Na ion} + \text{K ion} \leqq 15.0 \text{ (ml)}$$

$$1.0 \leqq \text{Mn ion} + \text{Ni ion} \leqq 5.0 \text{ (g/l)}$$

$$1.6 - 0.02T \leqq \text{Zn ion} \leqq 2.5 - 0.02T \text{ (g/l)}$$

$$3.2T^{-1} \leqq \text{free F ion} \leqq 8.0T^{-1} \text{ (g/l)}$$

$$0.014T - 0.02(\text{free F ion})^{-1} \leqq \text{free acidity} \leqq 0.027T - 0.02(\text{free F ion})^{-1} \text{ (g/l)}$$

where T represents a temperature (° C.) of said phosphate solution.

2. The phosphating method in accordance with claim 1, wherein said phosphate solution temperature is 20° C. to 60° C.

3. A phosphating solution employed for the phosphating method in accordance with claim 1, containing 0.1 to 2.1 g/l of Zn ions, 5 to 40 g/l of phosphate ions, 0 to 4 g/l of Ni ions, 0 to 3 g/l of Mn ions, 0 to 15 g/l of Na ions, 0 to 15 g/l of K ions, 0.05 to 0.4 g/l of free F ions, 0 to 3 g/l of a complex fluoride in terms of HF, and a conversion accelerator as main components.

4. The phosphating solution in accordance with claim 3, wherein the content of said Zn ions is 0.4 to 2.1 g/l.

5. The phosphating solution in accordance with claim 3, wherein the content of said phosphate ions as 10 to 30 g/l.

6. The phosphating solution in accordance with claim 3, wherein the content of said Ni ions is 0.1 to 2 g/l.

7. The phosphating solution in accordance with claim 3, wherein the content of said Mn ions is 0.5 to 3 g/l.

8. The phosphating solution in accordance with claim 3, wherein the content of said complex fluoride is 0.05 to 1 g/l.

9. The phosphating solution in accordance with claim 3, wherein said conversion accelerator contains 0.01 to 0.2 g/l of nitrite ions, 1 to 10 g/l of nitrate ions, 0.05 to 2.0 g/l of nitrobenzenesulfonate ions, 0.05 to 5.0 g/l of chlorate ions, or 0.05 to 2.0 g/l of hydrogen peroxide.

* * * * *